US005913483A

United States Patent [19]

Polk

[11] Patent Number: 5,913,483

[45] Date of Patent: Jun. 22, 1999

[54] SHOELACE AND TIED KNOT SECURING APPARATUS

[76] Inventor: Jessie M. Polk, 3441 Windy Hollow Cove, Memphis, Tenn. 38118

[21] Appl. No.: 09/049,570

[22] Filed: Mar. 27, 1998

Related U.S. Application Data

[60] Provisional application No. 60/049,974, Jun. 13, 1997.

[51] Int. Cl.[6] ..... F16G 11/00

[52] U.S. Cl. ..... 24/712.3; 24/712.2; 24/306

[58] Field of Search ..... 24/306, 442, 712, 24/712.1, 712.2, 712.3; 36/50.1

[56] References Cited

U.S. PATENT DOCUMENTS

| | | | |
|---|---|---|---|
| 4,291,439 | 9/1981 | Riti | 24/712.2 |
| 4,553,293 | 11/1985 | Blum | 24/119 |
| 4,571,854 | 2/1986 | Edens | 24/712.3 X |
| 4,780,936 | 11/1988 | Brecher | 24/712.2 |
| 4,879,787 | 11/1989 | Walls | 24/712.2 |
| 4,999,888 | 3/1991 | Miller | 24/712.3 |
| 5,042,119 | 8/1991 | Williams | 24/712.3 |
| 5,170,573 | 12/1992 | Clinch | 36/50.1 |
| 5,459,947 | 10/1995 | Lasher | 24/306 X |
| 5,778,500 | 7/1998 | Illingworth | 24/712.3 |

*Primary Examiner*—James R. Brittain
*Assistant Examiner*—Robert J. Sandy
*Attorney, Agent, or Firm*—Garvey, Smith, Nehrbass & Doody

[57] ABSTRACT

A shoelace securing device is in the form of an elongated strip of material with enlarged circular end portions that overlap upon assembly to cover the knot of a user's shoelaces. A rear side of the strip is completely covered with hook material to aid in gripping both the knot and adjacent shoelace material. The front surface has a loop patch at one end, the remainder of the front surface carrying an artistic design, other indicia, or logo. In one embodiment, the device includes two connectable, foldable strips of material. In each embodiment, a smooth surface is presented that can carry artwork, a slogan, words, a logo, or the like.

9 Claims, 4 Drawing Sheets

SHOELACE AND TIED KNOT SECURING APPARATUS

CROSS-REFERENCE TO RELATED APPLICATIONS

Priority of U.S. Provisional patent application Ser. No. 60/049,974, filed Jun. 13, 1997, incorporated herein by reference, is hereby claimed.

BACKGROUND OF THE INVENTION

1. Field of the Invention

The present invention relates to devices for securing ties such as cords, strings and laces and particularly knots of tied shoelaces of a shoe, ties of aprons and other tied clothing, and more particularly relates to an improved apparatus for holding shoelaces of a child's shoe in a tied position so that the knot (including the familiar bow-type tie) in such shoelaces does not become loose or untied even after vigorous activity such as running, jumping, sports and the like.

2. General Background of the Invention

Many children become injured each year when they fall, as by tripping on untied shoelaces or because they tangle their untied shoelaces in objects that are near them. This problem is particularly acute with young toddlers that have trouble tying their own shoelaces.

Several patents have been issued for constructions that attempt to solve the problem of shoelaces that become untied during use. These patents include the following:

| U.S. Pat. No. | Title | Issued | Inventor |
|---|---|---|---|
| 4,291,439 | Knot Securing Device | 09/29/81 | Riti |
| 4,553,293 | Reusable Tying Device | 11/19/85 | Blum |
| 4,571,854 | Knot Latch Device | 02/25/86 | Edens |
| 4,780,936 | Stay-Tied Shoe Laces | 11/01/88 | Brecher |
| 4,879,787 | Shoe Lace Knot Securing Device | 11/14/89 | Walls |
| 4,999,888 | Shoelace Retainer | 03/19/91 | Miller |
| 5,042,119 | Securement, Concealment And Containment Of Footwear Lace Ends | 08/27/91 | Williams |
| 5,170,573 | Miniature Pouch String Lock Device For Laces And The Like | 12/15/92 | Clinch |

BRIEF SUMMARY OF THE INVENTION

The present invention provides an improved construction for a cord, string, tie and lace securing device that can be made of a hook and loop material, for example, that is configured and positioned to enhance a gripping of, such as, a toddler's shoelaces or the mother's apron strings so that they will not become untied. The fastener itself is made so that the hook portion of the fastener adheres continuously to and interacts with the materials of the shoelace. The invention is conveniently illustrated in context of the familiar shoelace but is similarly effective on other ties such as the aforementioned cords or cloth strips such as apron "strings".

The "loop" fabric material is attached to one end of the device and on a side that is opposite the side covered with the hook material. Thus, the entire length of the device is covered with fabric hooks on one side thereof The fabric loop material is fastened by adhesive or the like on the side opposite the hook material and only at one end portion of the strip of material so that the fastener when wrapped around the knot of the shoelace will adhere to the hook material.

This construction enhances a closing of the fastener around the shoelace or other ties forming the knot. The interaction of the hook fabric with the ties, i.e., shoelaces and loop fabric in combination keeps the shoelace from coming untied.

In one embodiment, the apparatus is in the form of an elongated rectangular strip having two circular end portions or tabs to provide somewhat of a "dumbbell" shape. Upon assembly about a shoelace knot, the circular ends overlap. Other shapes of enlarged tab portions are similarly effective. The enlarged end portions are advantageously surfaces for ornamental designs. The selected shape of tab portion, e. g., round, oval or rectangular is as much a function of a selected ornamentation as holding effectiveness.

In another embodiment, an enlarged circular or oval shaped tab portion is attached to one end only of an elongated rectangular strip. These enlarged diameter tabs at one or both ends of the strip of material function to hide the knot portion of the apparatus and the rectangular strip portion. The enlarged diameter tab portion is substantially completely covered on its rear surface with hook material so that it grips not only the knot but the adjacent portions of the shoelaces during use.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
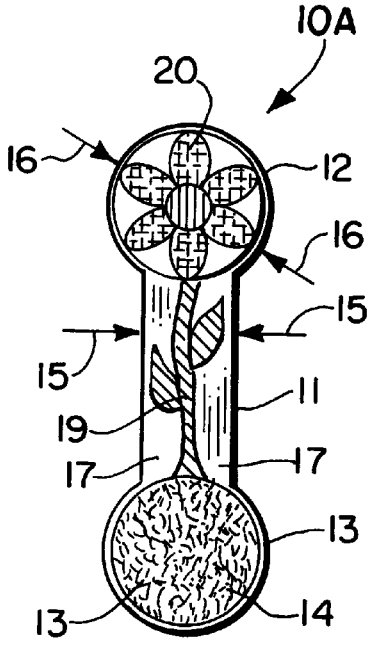

In FIG. 1, there can be seen the shoelace securing device according to the present invention designated generally by the numeral 10A. The shoelace securing apparatus 10A is comprised of an elongated strip of material having a pair of spaced apart circular tab portions 12, 13 connected by a rectangular strip central portion 11. The central portion 11 can be of a generally constant width indicated by arrows 15.

Figure 1A:
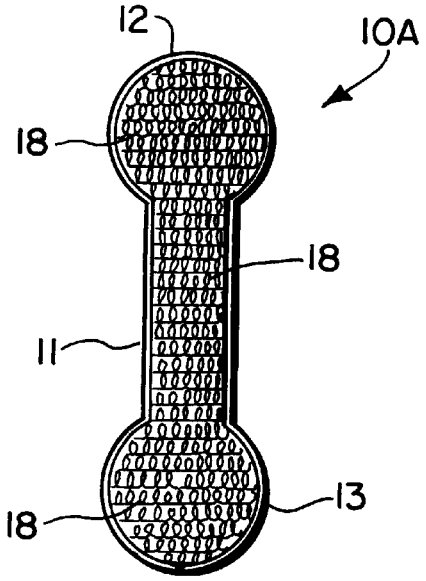

The circular tabs 12, 13 are preferably of a similar diameter designated by the arrows 16 in FIG. 1. The rectangular central strip 11 has a surface 17 that does not have any loop material or hook material thereon. Rather, this surface 17 can be used for carrying art work such as the stem 19 of a flower 20. The first circular loop 12 can also carry artwork such as the flower 20 shown in FIG. 1. The second tab 13 has an upper surface 14 covered with loop material. In FIG. 1A, the rear surface of shoelace securing apparatus 10A is shown as being completely covered from one end to the other with hook material 18.

The apparatus of the present invention is conveniently illustrated in the context of a shoelace securing device. Those skilled in the art will recognize from the previous and subsequent description that the illustrated apparatus according to the invention may be utilized to secure a variety of tied strings, cords and strips of material. Likewise, while certain end configurations of the illustrated tabular securing devices are shown as round or oval, it should be appreciated that the enlarged end portions may take other shapes such as polygonal (square, rectangular, triangular, etc.) or some enlarged irregular configuration.

Figure 2:
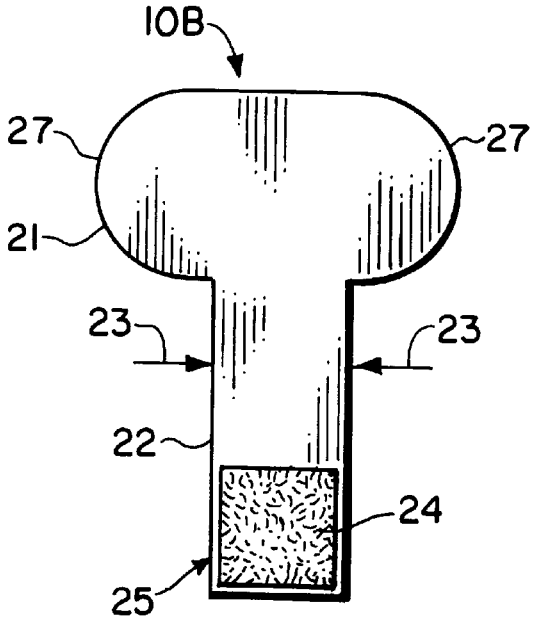
FIGS. 1 and 2 are top views of the apparatus of the present invention illustrating first and second constructions, including a first preferred construction having two enlarged tab end portions and a second alternate construction having a single enlarged tab end portion.
Figure 2A:
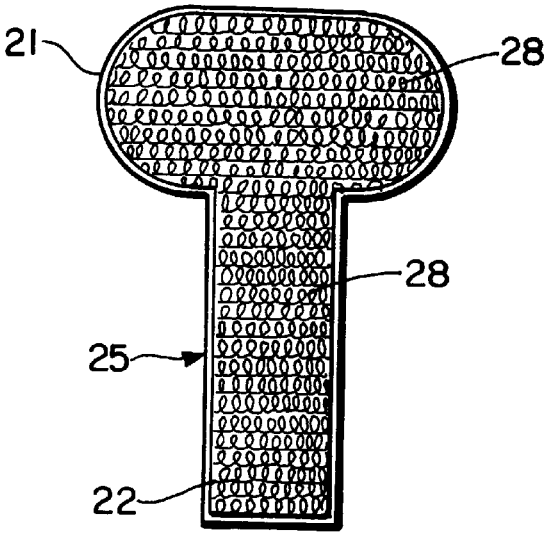
FIGS. 1A and 2A are plan views of the preferred embodiment of the apparatus of the present invention illustrating the rear or "hook" surfaces thereof.

In FIG. 2, the shoelace securing apparatus 10B has a first end portion being tab 21 and a second end in the form of a rectangular center elongated strip portion 22. Strip portion 22 can have a generally uniform width designated by the arrows 23 in FIG. 1. One end portion of the rectangular strip 22 is provided with a rectangular or square patch end portion 25 covered with loop material 24. In FIG. 2A, the shoelace securing apparatus 10B has a rear surface 25 substantially continuously covered by hook material 28. The enlarged tab end portion 26 is usefully oval shaped having an oval periphery 27. As mentioned above shapes such as rectangular may be preferred for certain applications.

Figure 3:
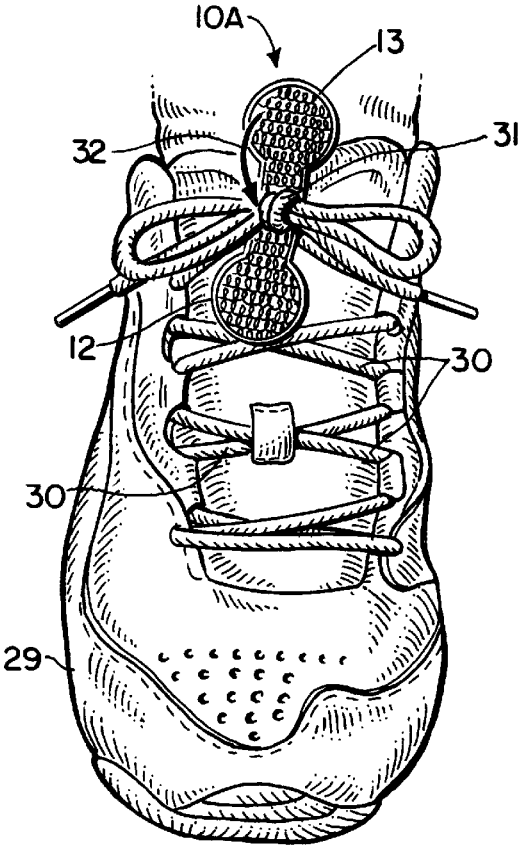
FIG. 3 is a perspective view of the preferred embodiment of the apparatus of the present invention shown during the first step of placement of the strip of material behind a user's laces and wherein the laces have been tied.

FIGS. 3–8 illustrate further the apparatus of the present invention designated by numerals 10A and 10B and the method of the present invention for applying a selected one of the apparatus 10A or 10B to a user's shoelace. In FIG. 3, a person's shoe 29 is shown having shoelaces 30 and a knot 31 that has been tied. In FIG. 3, the first step of the method shows that the shoelace securing apparatus 10A is placed behind the user's knot 31 or the selected apparatus 10A or 10B can be placed in position before the knot 31 is tied.

Figure 4:
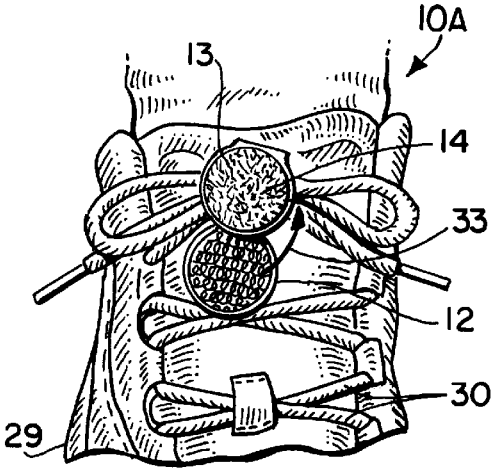
FIG. 4 is a perspective view of the preferred embodiment of the apparatus of the present invention illustrating the second step in the placement of the apparatus to a user's shoelaces, namely that of folding one of the circular tab portions over the knot to be secured.
Figure 5:
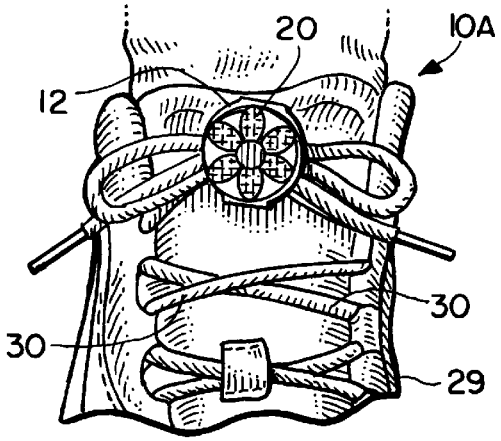
FIG. 5 is a perspective view of the preferred embodiment of the apparatus of the present invention and illustrating the final step of the method that secures the apparatus of the present invention to a user's tied shoelaces, wherein the second enlarged tab portion is folded onto the first enlarged tab portion so that the hook material of the second enlarged tab portion interfaces with and connects to the eyelet portion of the first enlarged tab portion of the strip material.

In the embodiment illustrated in FIG. 3, this places the circular tab 12 below the knot 31 and the circular tab 13 above the knot 31. The user then folds the tab 13 downwardly onto the knot 31 in the direction of arrow 32 (FIG. 3) so that it assumes the position shown in FIG. 4. This places the loop material 14 facing up as shown, and grips the knot 31 with the hook material that is on the rear surface, designated as hook material 18 in FIGS. 2A and 4. In FIGS. 4–5, the user then completes a securing of the device 10A to the user's shoelace knot 31 by folding the tab 12 upwardly in the direction of arrow 33. This places the flower 20 (or other artwork, design, logo, or slogan) in an exposed position to a viewer as seen in FIG. 5. The order of folding can be reversed if the tab portion (12,13) having the design is oriented upwardly of the knot.

Figure 6:
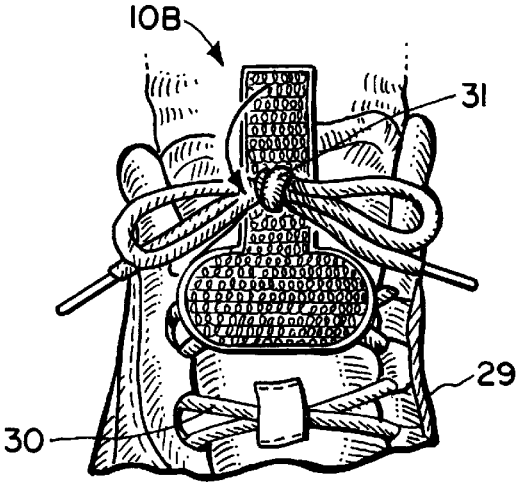
FIG. 6 is a perspective view of an alternate, second embodiment of the apparatus of the present invention shown during the first step of placement of the rectangular strip behind a user's laces and after the laces have been tied.
Figure 7:
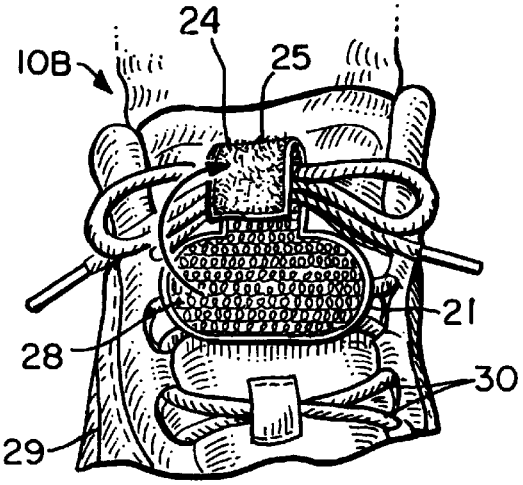
FIG. 7 is a perspective view of a preferred embodiment of the apparatus of the present invention shown during the second step of placement of the shoelace securing apparatus placed under the first crossing sections of the shoe laces to secure such section as well as the knot in the shoelaces.
Figure 8:
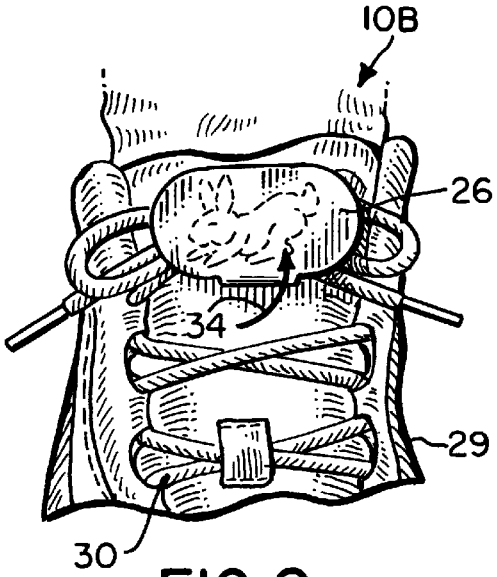
FIG. 8 is a perspective view of the second embodiment of the apparatus of the present invention.

FIGS. 6–8 similarly show the method for attaching the alternate shoelace securing apparatus 10B tied to a knot 31 of shoe 29. In FIG. 6, a users' shoe 29 is shown having shoelaces 30 and a knot 31 that has been tied. The first step of the method (see FIG. 6) shows placement of the shoelace securing apparatus 10B behind the knot 31. The apparatus 10B can be placed against the shoe tongue as shown in FIG. 6 before knot 31 is tied. In FIG. 7, the patch end portion 25 having loop material 24 has been folded onto the user's shoelace knot 31 as shown. The user completes the attachment by folding the oval tab 26 upwardly in the direction of arrow 34 as shown in FIG. 8 so that the hook material 28 in the rear surface of oval tab 26 engages the eye material 24 on the patch end portion 25.

Figure 9:
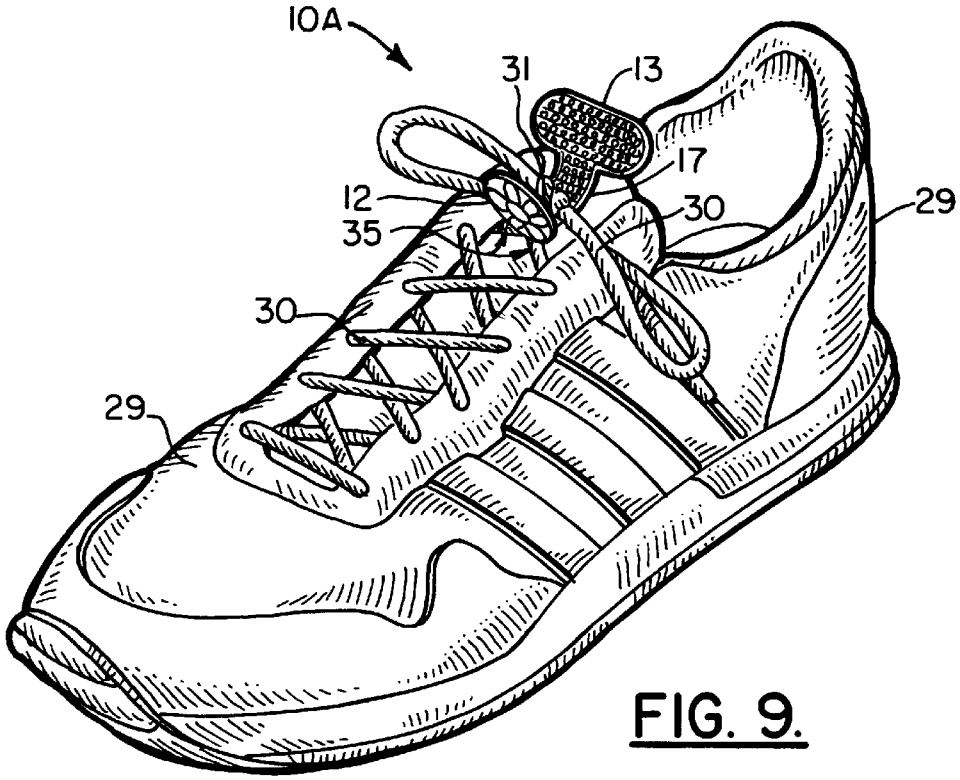
FIG. 9 is a perspective view of a third embodiment of the apparatus of the present invention shown during the first step of placement of the strip of material behind a user's laces and prior to the application of the retaining member thereto.

FIG. 9 illustrates a particularly effective method of securing such as a shoelace 30 wherein the central portion 11 of the securing apparatus 10A or 10B is placed underneath the first crossing section 35 of the shoelaces lying under knot 31. On closure of the securing apparatus, tab 13 is folded over knot 31 and tab 12 is folded over tab 13 in the manner described above. By engaging the securing device as described, the holding power of the fixed device 10A or 10B is improved.

Figure 10:
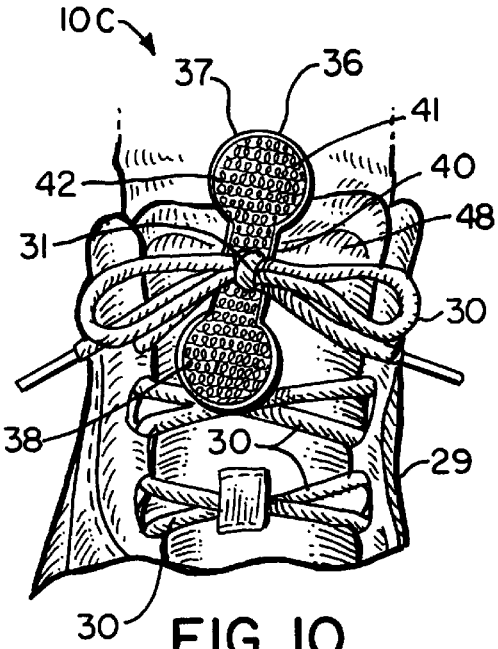
FIG. 10 is a fragmentary view of the third embodiment of the apparatus of the present invention illustrating the retaining strip portion thereof.
Figure 11:
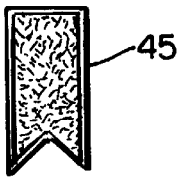
FIG. 11 is a fragmentary perspective view of the third embodiment of the apparatus of the present invention illustrating the assembly of retaining strip to the shoelace securing strip and after the laces have been tied.
Figure 12:
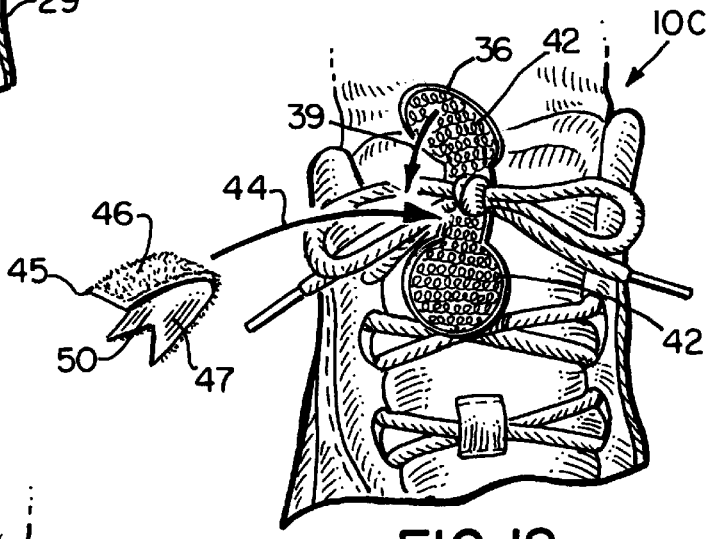
FIG. 12 is a perspective view of the third embodiment of the apparatus of the present invention after installation.
Figure 13:
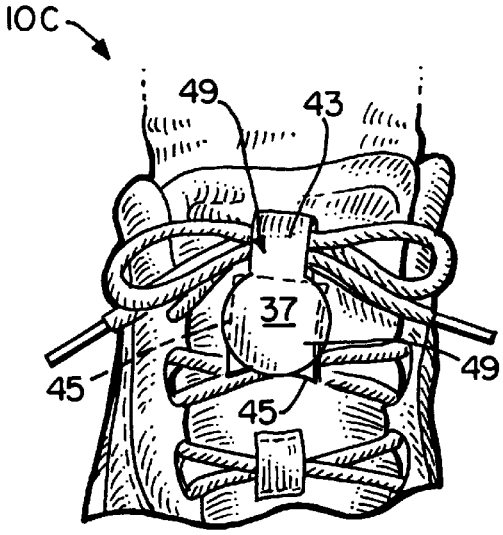
FIG. 13 is a perspective of the third embodiment of the apparatus, illustrated in FIG. 12, completely installed.

FIGS. 10–13 show a third embodiment of the apparatus of the present invention designated generally by the numeral 10C in FIGS. 10, 12, and 13.

Shoelace securing apparatus 10C is also used with a knot 31 that has been tied in a user's shoelace 30 of a shoe 29. In the embodiment of FIGS. 10–13, two separate elongated members are provided, including the elongated member 36 and the retaining strip member 45.

In FIG. 10, the elongated member 36 can include circular end portions 37, 38 connected by generally rectangular strip 40. Elongated member 36 is placed behind knot 31. It can be placed in this position against the upper end of the tongue 48 of the user's shoe 29 as shown, and prior to the tying of the knot 31. Once the user has tied the knot 31 as shown in FIG. 10, the user then places the retaining strip member 45 against the exposed hook surface 42 of the member 36, simultaneously folding the member 45 in half as shown in FIG. 12, and then collapsing the circular tabs 37, 38 upon the folded member 45 as shown in FIGS. 12–13. This folding of the elongated member 36 is indicated by the numeral 39. The placement of the folded retainer strip member 45 is shown by the arrow 44 in FIG. 12.

The retainer strip member 45 has a first surface that includes loop material 47 and a second opposite smooth surface 50 as shown. The loop material 46 engages hook material 42 on the surface of elongated member 36 that faces upwardly as shown in FIGS. 10 and 12.

By folding the member 45 in half as shown in FIG. 12, its loop material 46 is presented to hook material 42 on the exposed surface 41 of both tab 37 and tab 38. In FIG. 13, the completed securement is shown about the knot 31 of laces 30. A smooth surface 49 of elongated member 36 is opposite the hook surface 42. A selected design, name, logo or art work can be placed on smooth surface 49.

The following table lists the parts numbers and parts descriptions as used herein and in the drawings attached hereto.

PARTS LIST

| Part Number | Description |
|---|---|
| 10A | shoelace securing apparatus |
| 10B | shoelace securing apparatus |
| 10C | shoelace securing apparatus |
| 11 | rectangular strip |
| 12 | circular tab portion |
| 13 | circular tab portion |
| 14 | loop material |
| 15 | width arrow |
| 16 | diameter arrow |
| 17 | upper surface |
| 18 | rear or hook surface |
| 19 | stem |
| 20 | flower |
| 21 | first end |
| 22 | rectangular strip |
| 23 | width arrows |
| 24 | loop material |
| 25 | end portion |
| 26 | tab |
| 27 | perimeter |
| 28 | hook material |
| 29 | shoe |
| 30 | shoelaces |
| 31 | knot |
| 32 | arrow |
| 33 | arrow |
| 34 | arrow |
| 35 | crossing section |
| 36 | elongated member |
| 37 | tab |
| 38 | tab |
| 39 | arrow |
| 40 | connecting rectangular strip |
| 41 | surface |
| 42 | hook material |
| 43 | smooth surface |
| 44 | arrow |
| 45 | retainer strip member |
| 46 | loop material |
| 47 | smooth surface |
| 48 | tongue |
| 49 | smooth surface |
| 50 | smooth surface |

The foregoing embodiments are presented by way of example only; the scope of the present invention is to be limited only by the following claims.

I claim:

1. A shoelace knot holding apparatus for a tied shoelace comprising:

a) a strip of material having front and rear surfaces, an elongated rectangular strip portion of generally uniform width and two enlarged end portions of similar size and shape that overlap upon assembly so that one aligns with and covers the other and each end portion being enlarged and generally circular and of a diameter that is larger than the width of the rectangular portion;

b) the front surface having a patch of loop material near an end of the rectangular portion;

c) the entire rear surface of said strip portion being covered with hook material;

d) the enlarged, generally circular end having hook material on its rear surface for gripping both the patch of loop material and adjacent shoelace material during use; and e) wherein the strip of material is of a length that enables a tied shoelace knot to be encircled when the circular end portion grips and overlaps the patch of loop material.

2. The apparatus of claim 1 wherein the front surface has an artistic design thereon.

3. The apparatus of claim 1 wherein the strip of material is about two inches long.

4. The apparatus according to claim 1 wherein the strip of material is of a length that enables the shoelace knot and the crossing of the shoelace adjacent the knot to be encircled when the circular end portion grips and overlaps the patch of loop material.

5. A knot holding apparatus for a tied knot comprising:

a) a first strip of material having front and rear surfaces, an elongated rectangular portion of generally uniform width and disposed at one end thereof an enlarged tab having a width that is larger than the width of the rectangular portion;

b) the front surface having a patch of loop material near an end of the rectangular portion;

c) a second strip of material having substantially an entire surface covered with hook material;

d) wherein the first strip of material is of a length that enables the knot to be encircled; and e) wherein the second strip of material grips the loop material of the first strip of material to secure the knot.

6. A knot holding apparatus for a tied knot comprising:

a) a strip of material having front and rear surfaces, an elongated rectangular portion of generally uniform width and disposed at each end thereof an enlarged tab having a width that is larger than the width of the rectangular portion, b) the front surface having a patch of loop material near an end of the rectangular portion at a first enlarged tab;

c) the entire rear surface of said strip material being covered with hook material;

d) the second enlarged tab having hook material on its rear surface for gripping both the patch of loop material on said first enlarged tab and adjacent shoelace material during use; and e) wherein the strip of material is of a length that enables the knot to be encircled when the tab portion grips and overlaps the patch of loop material.

7. The apparatus of claim 6 wherein the front surface of at least one of said tabs has an artistic design thereon.

8. The apparatus of claim 6 wherein said enlarged tab is polygonal in shape.

9. The apparatus of claim 8 wherein said enlarged tab is rectangular.

* * * * *